US007907131B2

(12) United States Patent
Su et al.

(10) Patent No.: US 7,907,131 B2
(45) Date of Patent: Mar. 15, 2011

(54) LOW COLOR-SHIFT LIQUID CRYSTAL DISPLAY AND DRIVING METHOD THEREFOR

(75) Inventors: Jen-Jia Su, Budai Township (TW); Ming-Feng Tien, Tainan (TW); Chia-Leng Yang, Hsinchu (TW); Ting-Jui Chang, Taipei (TW); Po-Lun Chen, Chiayi (TW)

(73) Assignee: Au Optronics Corp., Hsinchu (TW)

( * ) Notice: Subject to any disclaimer, the term of this patent is extended or adjusted under 35 U.S.C. 154(b) by 1143 days.

(21) Appl. No.: 11/525,087

(22) Filed: Sep. 22, 2006

(65) Prior Publication Data

US 2007/0211007 A1 Sep. 13, 2007

(30) Foreign Application Priority Data

Mar. 9, 2006 (TW) ..... 95107989 A

(51) Int. Cl.
*G09G 5/00* (2006.01)

(52) U.S. Cl. ..... 345/204; 345/205; 345/211; 345/209

(58) Field of Classification Search ..... 345/87–100, 345/204, 209, 690, 76, 77, 205; 349/33, 349/38, 39, 46, 104, 113, 114, 129, 138, 349/139, 144, 187, 48; 324/158.1, 765, 770; 313/500; 315/169.3
See application file for complete search history.

(56) References Cited

U.S. PATENT DOCUMENTS 5,610,739 A * 3/1997 Uno et al. ..... 349/39
6,072,555 A * 6/2000 Mizutome et al. ..... 349/144
6,486,930 B1 * 11/2002 Kwon ..... 349/48
6,525,710 B1 * 2/2003 Kwon ..... 345/100
6,788,757 B1 * 9/2004 Lu et al. ..... 377/69
6,850,305 B2 * 2/2005 Hsieh et al. ..... 349/144
6,922,183 B2 7/2005 Ting et al.
6,982,690 B2 * 1/2006 Lee et al. ..... 345/87
6,999,053 B2 * 2/2006 Lee et al. ..... 345/92
7,084,942 B2 * 8/2006 Luo ..... 349/114
7,129,923 B2 * 10/2006 Lu ..... 345/92
7,256,775 B2 * 8/2007 Eom ..... 345/204
7,277,077 B2 * 10/2007 Bu et al. ..... 345/98
7,471,274 B2 * 12/2008 Kim ..... 345/88
7,522,147 B2 * 4/2009 Lin et al. ..... 345/100
7,535,248 B2 * 5/2009 Chen et al. ..... 324/770
7,576,724 B2 * 8/2009 Lin et al. ..... 345/98
2003/0117422 A1 * 6/2003 Hiyama et al. ..... 345/690

(Continued)

FOREIGN PATENT DOCUMENTS

JP 05265045 A 10/1993

(Continued)

*Primary Examiner* — Prabodh M Dharia

(74) *Attorney, Agent, or Firm* — Rabin & Berdo, P.C.

(57) ABSTRACT

A liquid crystal display including a number of scan lines, a number of data lines, a pixel, a first switch circuit, and a second switch circuit is provided. The scan lines include an $N^{th}$ scan line and an $(N+1)^{th}$ scan line, where N is a positive integer. The pixel includes a first sub-pixel and a second sub-pixel. The first switch circuit is coupled to both the $N^{th}$ scan line and the $(N+1)^{th}$ scan line and is used for controlling the second sub-pixel. The second switch circuit is coupled to the $N^{th}$ scan line and is used for controlling the first sub-pixel. The pixel is used for displaying a red, a green, a blue, or a white color.

6 Claims, 8 Drawing Sheets

U.S. PATENT DOCUMENTS

2003/0151574 A1* 8/2003 Chang et al. ..... 345/89
2003/0169223 A1* 9/2003 Lee et al. ..... 345/92
2003/0227429 A1* 12/2003 Shimoshikiryo ..... 345/90
2003/0227433 A1* 12/2003 Moon ..... 345/100
2004/0004685 A1* 1/2004 Luo ..... 349/113
2004/0051690 A1* 3/2004 Chang ..... 345/92
2004/0051835 A1* 3/2004 Hsieh et al. ..... 349/143
2005/0116615 A1* 6/2005 Matsumoto et al. ..... 313/500
2005/0213015 A1* 9/2005 Shimoshikiryo ..... 349/144
2005/0285827 A1* 12/2005 Eom ..... 345/76
2006/0007077 A1* 1/2006 Joo et al. ..... 345/77
2006/0109224 A1* 5/2006 Chang et al. ..... 345/89
2006/0145964 A1* 7/2006 Park et al. ..... 345/76
2006/0186822 A1* 8/2006 Park ..... 315/169.3
2007/0063945 A1* 3/2007 Hung et al. ..... 345/88
2007/0146278 A1* 6/2007 Pan et al. ..... 345/92
2007/0188523 A1* 8/2007 Lee et al. ..... 345/690

FOREIGN PATENT DOCUMENTS

WO WO-2004/086129 A1 10/2004

* cited by examiner

LOW COLOR-SHIFT LIQUID CRYSTAL DISPLAY AND DRIVING METHOD THEREFOR

This application claims the benefit of Taiwan Patent application Serial No. 95107989, filed Mar. 9, 2006, the subject matter of which is incorporated herein by reference.

BACKGROUND OF THE INVENTION

1. Field of the Invention

The invention relates in general to a liquid crystal display and a driving method therefor, and more particularly to a low color-shift liquid crystal display and a driving method therefor.

2. Description of the Related Art

Along with the trend in thinning the thickness of display, liquid crystal display is currently widely applied in various electronic products such as mobile phone, notebook, and color TV, and so on. However, in a conventional color liquid crystal display, only one driving voltage is provided to a pixel during a frame period, therefore the corresponding liquid crystal tilts to an angle and results in color-shift due to the change in the view-angle. As shown in FIG. 1, a conventional pixel equivalent circuit diagram is shown. The pixel is disposed at the junction of the $M^{th}$ data line and the $N^{th}$ scan line. The equivalent circuit includes a thin film transistor $T_{11}$, a liquid crystal capacitor $C_{LC}$, and a storage capacitor $C_{ST}$. As shown in FIG. 1, the pixel is controlled by the thin film transistor $T_{11}$, such that only one driving voltage is provided to the pixel during a frame period.

FIG. 2 is a transmittance vs. driving voltage diagram of a conventional liquid crystal display under different view-angles (θ). FIG. 3 a grey level vs. driving voltage diagram of a conventional liquid crystal display under different view-angles (θ). As shown in FIG. 2 and FIG. 3, under the same driving voltage or the same grey level, different view-angles will result in different levels of transmittance, hence causing color-shift to the display frame. Therefore, how to improve color-shift to enhance the image quality of liquid crystal display has become an imminent challenge to the liquid crystal display industry.

SUMMARY OF THE INVENTION

It is therefore an object of the invention to provide a color-shift liquid crystal display and a driving method therefor capable of effectively reducing color-shift to improve the image quality of the display.

The invention achieves the above-identified object by providing a liquid crystal display including a number of scan lines, a number of data lines, a pixel, a first switch circuit, and a second switch circuit. The scan lines includes an $N^{th}$ scan line and an $(N+1)^{th}$ scan line, where N is a positive integer. The pixel includes a first sub-pixel and a second sub-pixel. The first switch circuit is coupled to the $N^{th}$ scan line and the $(N+1)^{th}$ scan line and is used for controlling the second sub-pixel. The second switch circuit is coupled to the $N^{th}$ scan line and is used for controlling the first sub-pixel. The pixel is used for displaying a red, a green, a blue, or a white color.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
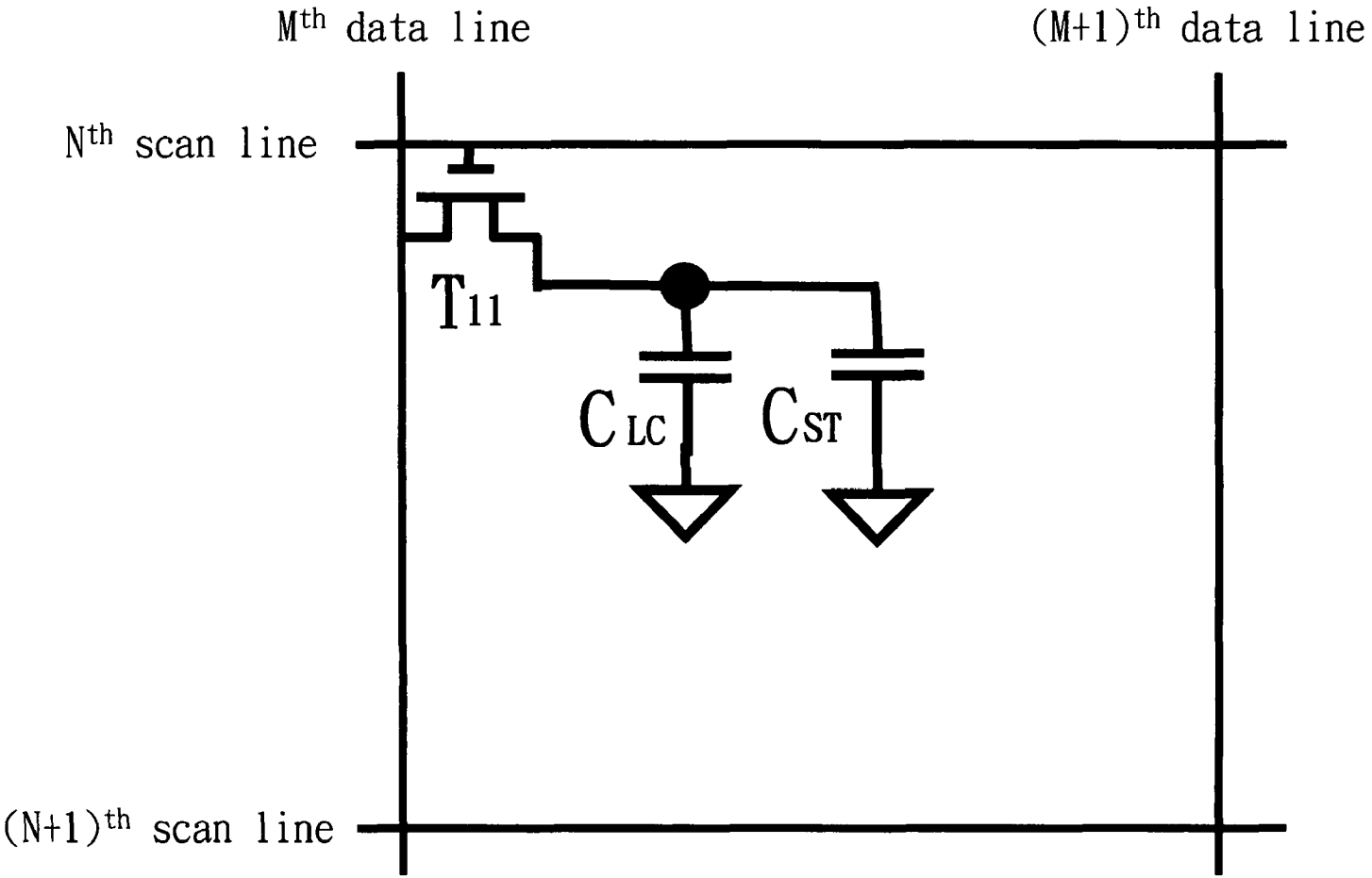
FIG. 1(RELATED ART)
FIG. 1 (Related Art) is a conventional pixel equivalent circuit diagram.
Figure 2:
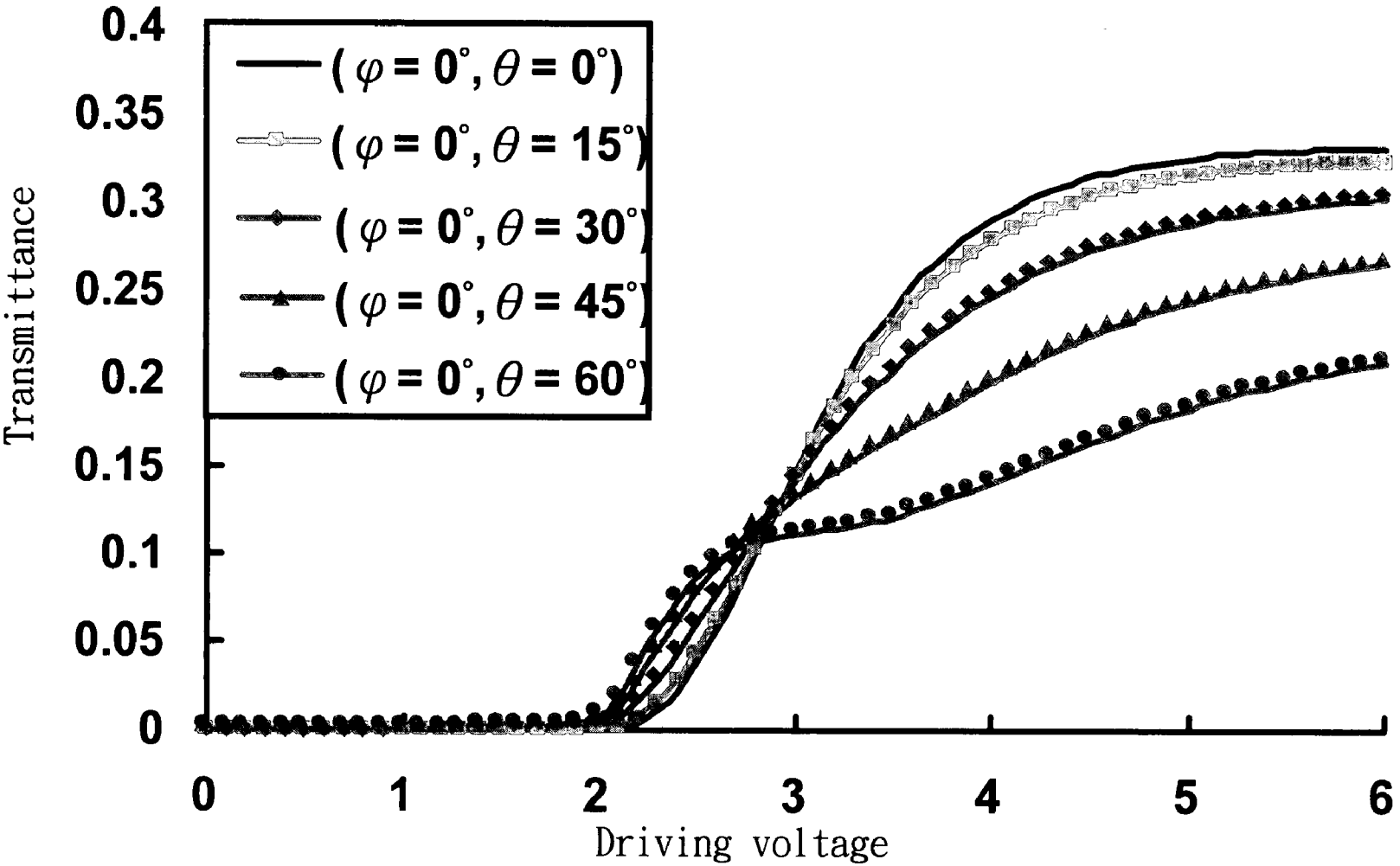
FIG. 2 (RELATED ART)
FIG. 2(Related Art) is a transmittance vs. driving voltage diagram of a conventional liquid crystal display under different view-angles.
Figure 3:
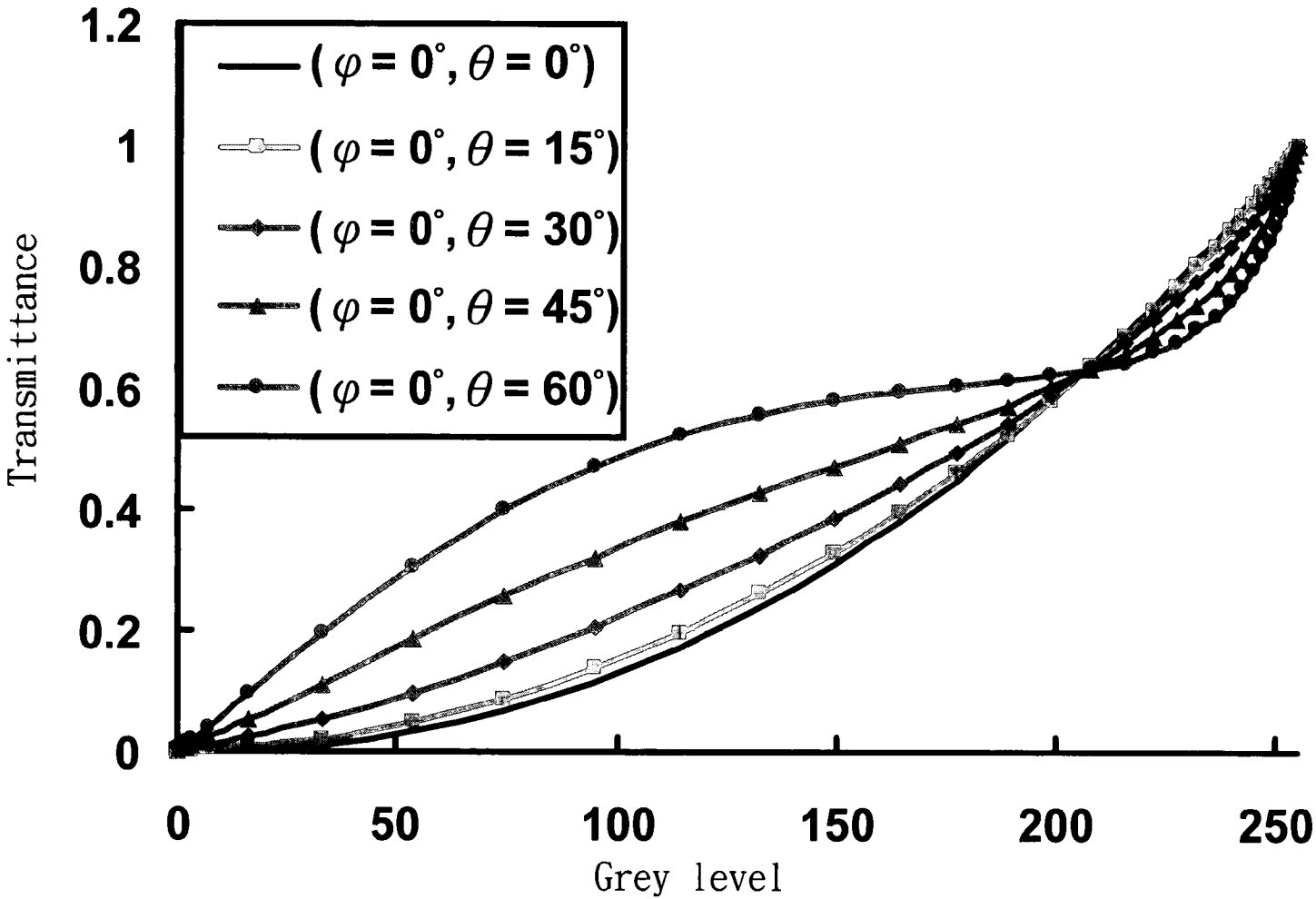
FIG. 3 (RELATED ART)
FIG. 3(Related Art) is a grey level vs. driving voltage diagram of a conventional liquid crystal display under different view-angles.
Figure 4:
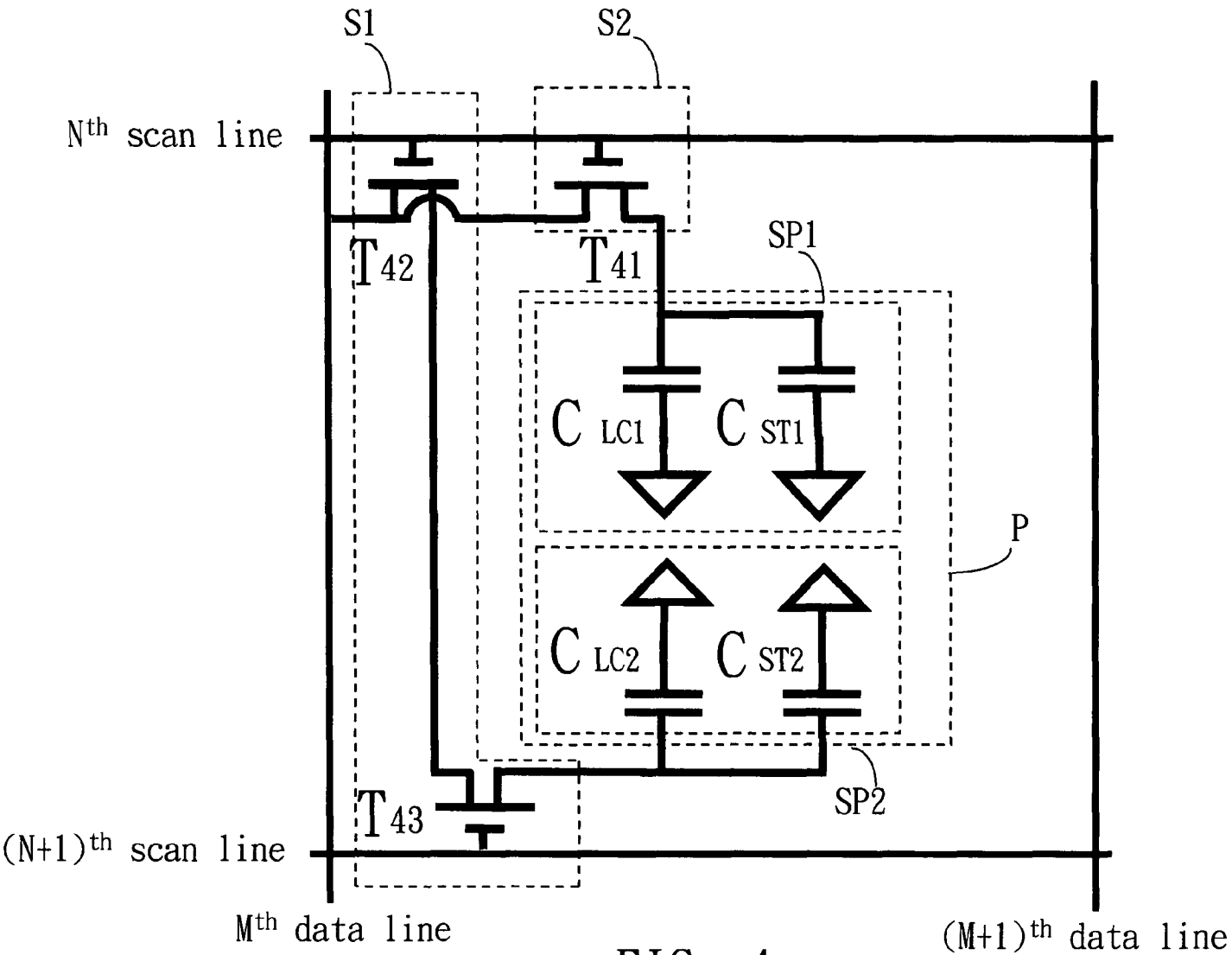
FIG. 4 is a pixel equivalent circuit diagram of a liquid crystal display according to a preferred embodiment of the invention.

Referring to FIG. 4, a pixel equivalent circuit diagram of a liquid crystal display according to a preferred embodiment of the invention is shown. The pixel P is disposed at the junction of the $M^{th}$ data line and the $N^{th}$ scan line and includes a first sub-pixel SP1, a second sub-pixel SP2, a first switch circuit S1, and a second switch circuit S2. The first sub-pixel SP1 is equalized by a liquid crystal capacitor $C_{LC1}$ and a storage capacitor $C_{ST1}$. The second sub-pixel SP2 is equalized by a liquid crystal capacitor $C_{LC2}$ and a storage capacitor $C_{ST2}$.

The first switch circuit S1 includes a thin film transistor $T_{42}$ and a thin film transistor $T_{43}$. The second switch circuit S2 includes a thin film transistor $T_{41}$. The thin film transistor $T_{41}$ includes a first gate, a first source and a first drain. The first gate is controlled by the $N^{th}$ scan line. The first source is coupled to the $M^{th}$ data line. The first drain is coupled to the first sub-pixel SP1. The thin film transistor $T_{42}$ includes a second gate, a second source and a second drain. The second gate is controlled by the $N^{th}$ scan line. The second source is coupled to the $M^{th}$ data line. The thin film transistor $T_{43}$ includes a third gate, a third source and a third drain. The third gate is controlled by the $(N+1)^{th}$ scan line. The third source is coupled to the second drain. The third drain is coupled to the second sub-pixel SP2.

When the thin film transistor $T_{42}$ and the thin film transistor $T_{43}$ are turned on at the same time, a sub-pixel voltage V1 is transmitted to the first sub-pixel SP2 by the $M^{th}$ data line. When the thin film transistor $T_{41}$ is turned on but the thin film transistor $T_{43}$ is not turned on, a sub-pixel voltage V2 is transmitted to the first sub-pixel SP1 by the $M^{th}$ data line.

Figure 5:
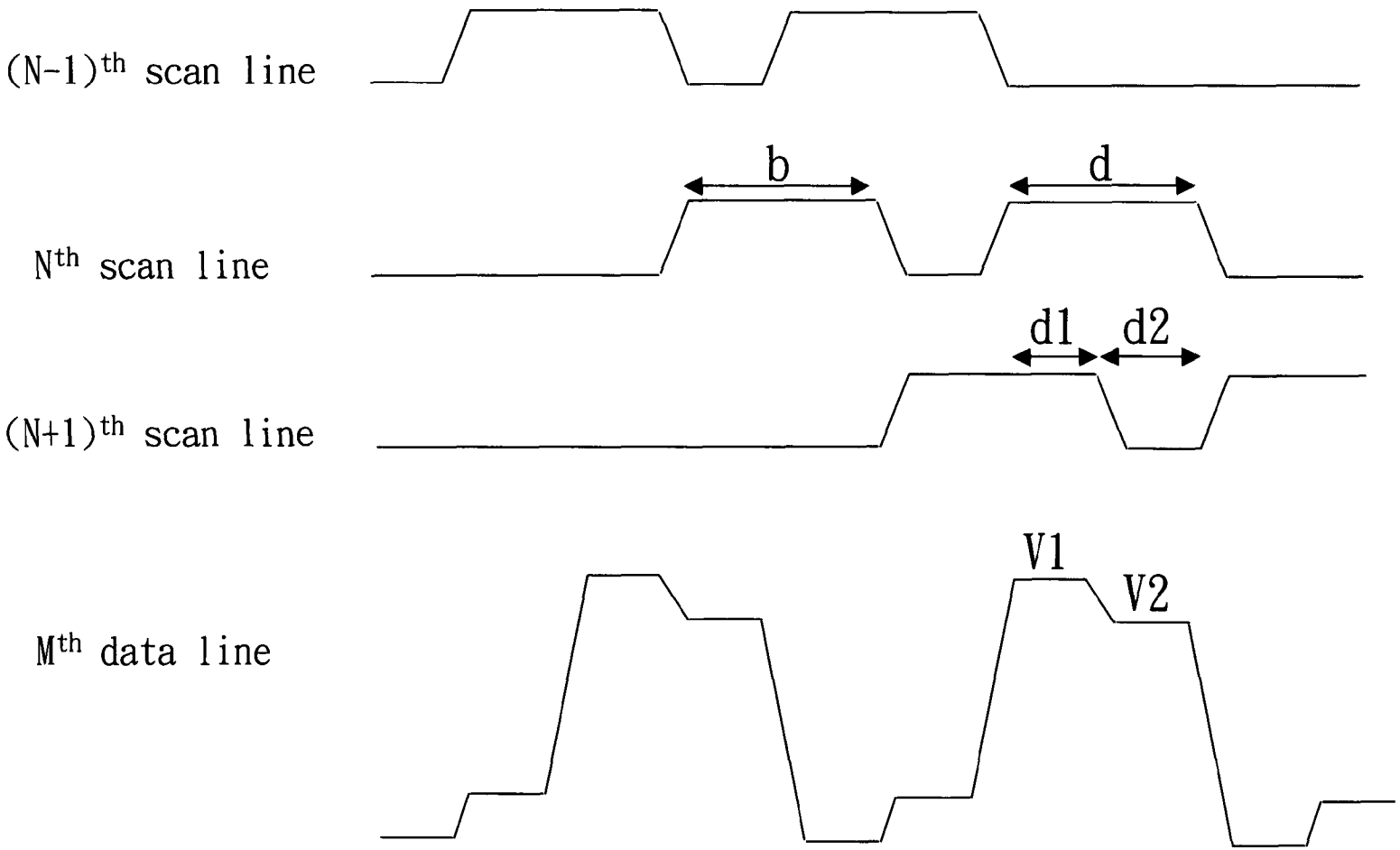
FIG. 5 is a method for driving the pixel of a liquid crystal display according to a preferred embodiment of the invention.

Referring to both FIG. 4 and FIG. 5. FIG. 5 is a method for driving the pixel of a liquid crystal display according to a preferred embodiment of the invention. As shown in FIG. 5, during a frame period, the voltage level of the $N^{th}$ scan line is maintained at high level for a duration b and a duration d. The duration d includes a duration d1 and a duration d2. The voltage level of the $(N+1)^{th}$ scan line is at a high level during the duration d1 and is at a low level during the duration d2. Therefore, the sub-pixel voltage V1 is provided to the first sub-pixel SP1 and the second sub-pixel SP2 respectively during the duration d1, and the sub-pixel voltage V2 is only provided to the first sub-pixel SP1 during the duration d2. Meanwhile, the first sub-pixel SP1 is driven by the sub-pixel voltage V2, and the second sub-pixel SP2 is driven by the sub-pixel voltage V1. Therefore, the total charge time for the first sub-pixel SP1 equals (d1+d2), but the total charge time for the second sub-pixel SP2 is d1 only.

The view-angle characteristic of the pixel P is the average of the accumulated sum of the view-angle characteristic of the first sub-pixel SP1 and the second sub-pixel SP2. Through appropriate design, the arrangement of the liquid crystal molecules of the first sub-pixel SP1 and the second sub-pixel SP2, the view-angle characteristic of the first sub-pixel SP1 and the view-angle characteristic of the second sub-pixel SP2 are compensated by each other, hence reducing the color-shift caused due to difference in view-angle. Besides, the data line of the present embodiment of the invention is driven according to the dot inversion mode. However, other modes such as the frame inversion mode, the row inversion mode and the column inversion mode are also applicable to the present embodiment of the invention.

Figure 6A:
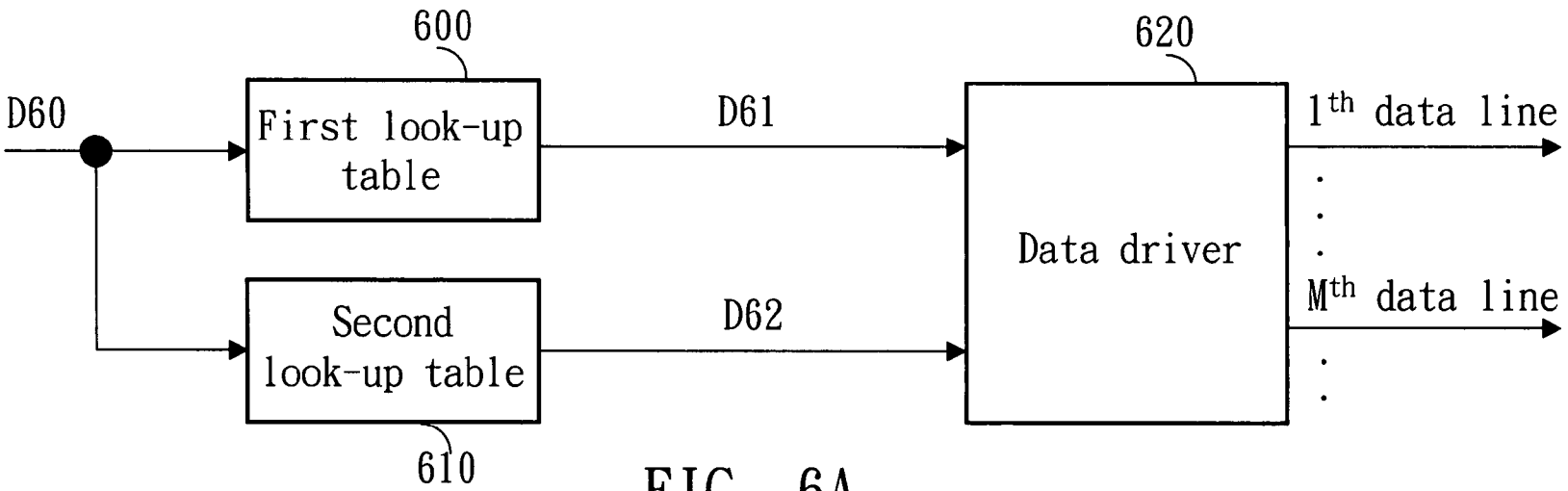
FIG. 6A is a first circuit block diagram for driving a data line according to a preferred embodiment of the invention.

Referring to FIG. 6A, a first circuit block diagram for driving a data line according to a preferred embodiment of the invention is shown. As shown in FIG. 6A, the circuit block diagram includes a first look-up table 600, a second look-up table 610 and a data driver 620. The first look-up table 600 is used for outputting a first sub-pixel data value D61 for controlling the first sub-pixel SP1 according to original pixel data D60. The second look-up table 610 is used for outputting a second sub-pixel data value D62 for controlling the second sub-pixel SP2 according to the original pixel data D60. The data driver 620 is used for outputting a sub-pixel voltage V1 and a sub-pixel voltage V2 respectively corresponding to the first sub-pixel SP1 and the second sub-pixel SP2 to the $M^{th}$ data line according to the first sub-pixel data value D61 and the second sub-pixel data value D62. By using the first look-up table 600 and the second look-up table 610 to control the sub-pixel voltage V1 and the sub-pixel voltage V2 respectively, the pixel P has two voltages within. Therefore, each grey level can be optimized to achieve optimum display effect.

When selecting a sub-pixel voltage V1 and a sub-pixel voltage V2 corresponding to each grey level, the present embodiment of the invention obtains an optimized view-angle for each grey level according to a trial-and-error method. Moreover, under the circumstances of certain grey levels such as the normally white state, the sub-pixel voltage V1 can be designed to be equal to the sub-pixel voltage V2 so as to avoid transmittance loss.

Figure 6B:
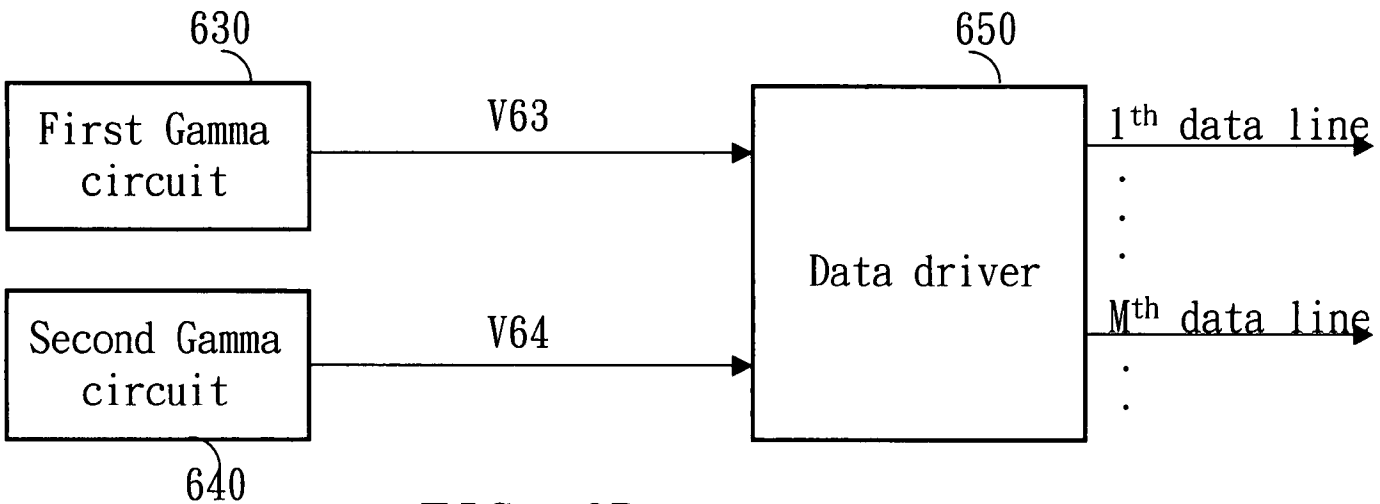
FIG. 6B is a second circuit block diagram for driving a data line according to a preferred embodiment of the invention.
Figure 7A:
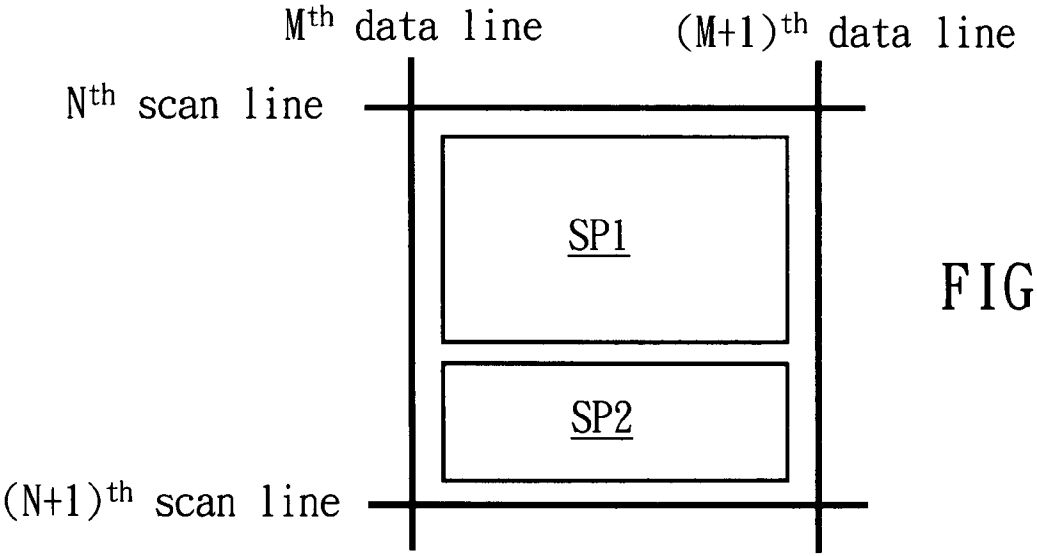
FIG. 7A~FIG. 7D are respective layout diagrams of a first sub-pixel and a second sub-pixel according to a preferred embodiment of the invention.
Figure 7B:
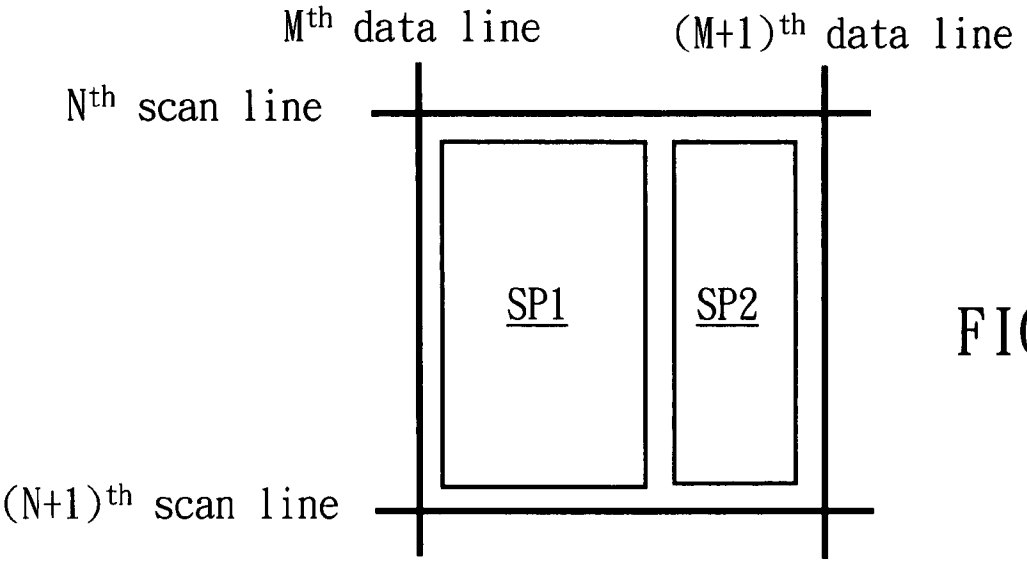
Figure 7C:
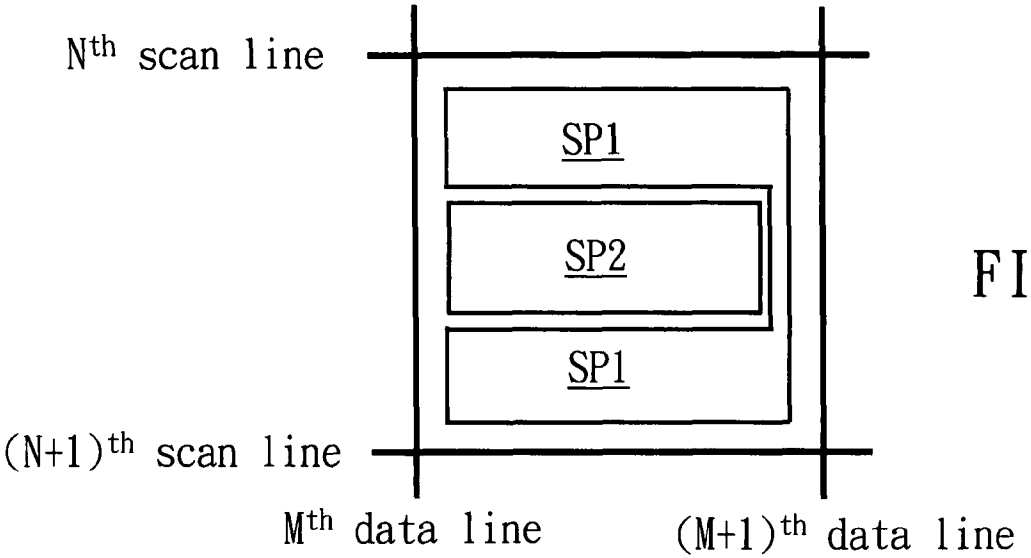
Figure 7D:
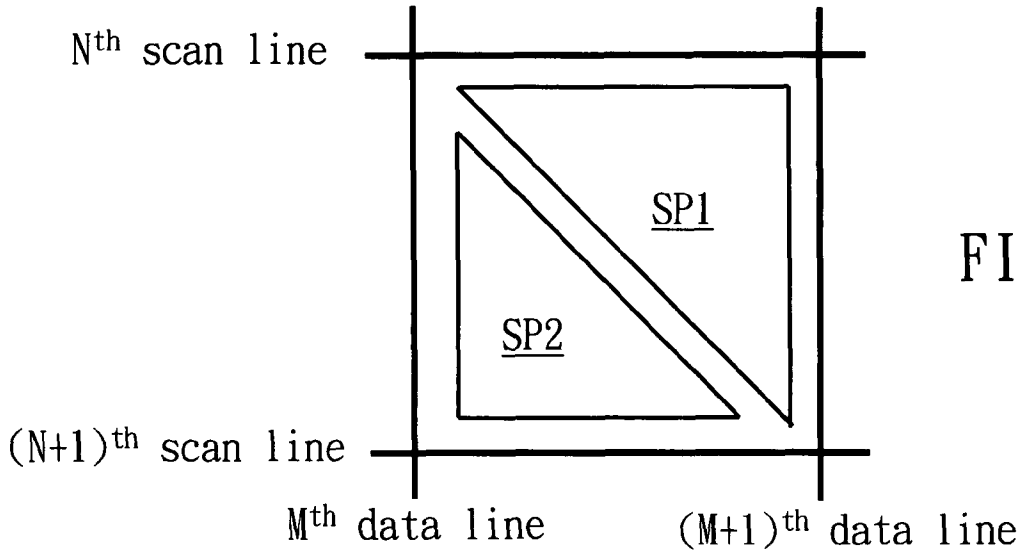

Referring to FIG. 6B, a second circuit block diagram for driving a data line according to a preferred embodiment of the invention is shown. As shown in FIG. 6B, the circuit block diagram includes a first Gamma circuit 630, a second Gamma circuit 640 and a data driver 650. The first Gamma circuit 630 is used for generating a first group Gamma voltage V63 corresponding to the first sub-pixel SP1. The second Gamma circuit 640 is used for generating a second group Gamma voltage V64 corresponding to the second sub-pixel SP2. The data driver 650 is used for respectively outputting a sub-pixel voltage V1 and a sub-pixel voltage V2 corresponding to the first sub-pixel SP1 and the second sub-pixel SP2 to the $M^{th}$ data line according to the first group Gamma voltage V63 and the second group Gamma voltage V64. Likewise, the above effect achieved by using the first look-up table 600 and the second look-up table 610 which differs with the first look-up table 600 can also be achieved by using the first Gamma circuit 630 and the second Gamma circuit 640 which differs with the first Gamma circuit 630, and the same procedures are not repeated here.

Referring to FIG. 7A~FIG. 7D, respective layout diagrams of the first sub-pixel SP1 and the second sub-pixel SP2 according to a preferred embodiment of the invention are shown. The arrangement of the first sub-pixel SP1 and the second sub-pixel SP2 is top down in FIG. 7A, left-to-right in FIG. 7B, alternating in FIG. 7C, and diagonally facing each other in triangular shapes in FIG. 7D. In the present embodiment of the invention, since the total charge time for the second sub-pixel SP2 is shorter than the total charge time for the first sub-pixel SP1, the layout area of the first sub-pixel SP1 is larger than the layout area of the second sub-pixel SP2 to prevent the second sub-pixel SP2 from having insufficient charge time. The preferable ratio of the layout area of the first sub-pixel SP1 to the layout area of the second sub-pixel SP2 ranges approximately 9:1~1:1.

According to the present embodiment of the invention, a pixel is divided into a first sub-pixel and a second sub-pixel, and by means of different driving methods, the two sub-pixels of the pixel are respectively driven by two different voltages, causing two different angles of inclination to the liquid crystal such that the optical effect in the display domain of the two sub-pixels can compensate for each other. Take the multi-domain vertical alignment liquid crystal display for example. The conventional four display domains are changed into eight display domains, such that the difference between the luminance when the display is viewed from a front view-angle and the luminance when the display is viewed from a slant view-angle is compensated, and that the view-angle effect of the liquid crystal display using eight display domains is better than the view-angle effect of the liquid crystal display using four display domains. Take the transflective liquid crystal display for example. The pixels in the reflective area and the pixels in the transmissive area are driven by two different voltages respectively, such that the optical effect in the reflective area is matched to the optical effect in the transmissive area. If a twisted nematic liquid crystal display is used, the color-shift caused by the difference in view-angle can also be reduced by increasing the number of display domains.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A liquid crystal display, comprising:

a plurality of scan lines having an Nth scan line and an (N+1)th scan line, where N is a positive integer;

a plurality of data lines having an Mth data line, where M is a positive integer;

a pixel having a first sub-pixel and a second sub-pixel, the first sub-pixel and the second sub-pixel being both disposed between the Nth scan line and the (N+1)th scan line, the first sub-pixel and the second sub-pixel being both coupled to the Mth data line and disposed on the same side of the Mth data line;

a first switch circuit, electrically coupled to both the Nth scan line and the (N+1)th scan line, for controlling the second sub-pixel; and a second switch circuit, electrically coupled to the Nth scan line, for controlling the first sub-pixel;

wherein the first switch circuit comprises:

a first transistor having a first gate, a first source and a first drain, the first gate being controlled by the Nth scan line, the first source being coupled to the Mth data line; and a second transistor having a second gate, a second source and a second drain, the second gate being controlled by the (N+1)th scan line, the second source being coupled to the first drain, the second drain being coupled to the second sub pixel; and wherein when the first transistor and the second transistor are turned on at the same time, the second sub-pixel receives a sub-pixel voltage from the Mth data line via the first transistor and the second transistor.

2. The liquid crystal display of claim 1, wherein the ratio of the layout area of the first sub-pixel to the layout area of the second sub-pixel ranges approximately from 9:1 to 1:1.

3. The liquid crystal display of claim 1, wherein the layout area of the first sub-pixel is larger than the layout area of the second sub-pixel.

4. The liquid crystal display of claim 1, further comprising:

a first look-up table for outputting a first sub-pixel data value to control the first sub-pixel according to an original pixel data;

a second look-up table for outputting a second sub-pixel data value to control the second sub-pixel according to the original pixel data; and a data driver, electrically coupled to the data lines, for outputting a first sub-pixel voltage and a second sub-pixel voltage corresponding to the first sub-pixel and the second sub-pixel, respectively, according to the first sub-pixel data value and the second sub-pixel data value.

5. The liquid crystal display of claim 1, further comprising:

a first Gamma circuit for generating a first group Gamma voltage corresponding to the first sub-pixel;

a second Gamma circuit for generating a second group Gamma voltage corresponding to the second sub-pixel; and a data driver, electrically coupled to the data lines, for outputting a first sub-pixel voltage and a second sub-pixel voltage corresponding to the first sub-pixel and the second sub-pixel, respectively, according to the first group Gamma voltage and the second group Gamma voltage.

6. The liquid crystal display of claim 1, wherein the second switch circuit comprises a third transistor having a third gate, a third source and a third drain, the first gate of the first transistor and the third gate of the third transistor are controlled by the Nth scan line, the third source is coupled to the Mth data line, and the third drain is coupled to the first sub-pixel.

* * * * *